US010957333B2

(12) United States Patent
Eronen et al.

(10) Patent No.: US 10,957,333 B2
(45) **Date of Patent: *Mar. 23, 2021**

(54) PROTECTED EXTENDED PLAYBACK MODE

(71) Applicant: Nokia Technologies Oy, Espoo (FI)

(72) Inventors: Antti Eronen, Tampere (FI); Miikka T. Vilermo, Siuro (FI); Arto J. Lehtiniemi, Lempäälä (FI); Lasse J. Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 16/189,530

(22) Filed: Nov. 13, 2018

(65) Prior Publication Data

US 2019/0080707 A1 Mar. 14, 2019

Related U.S. Application Data

(63) Continuation of application No. 15/267,360, filed on Sep. 16, 2016, now Pat. No. 10,210,881.

(51) Int. Cl.
*G10L 19/16* (2013.01)
*H04S 7/00* (2006.01)
(Continued)

(52) U.S. Cl.
CPC ..... *G10L 19/167* (2013.01); *H04R 3/005* (2013.01); *H04S 7/30* (2013.01); *G10L 19/008* (2013.01);
(Continued)

(58) Field of Classification Search
CPC ..... G10L 19/008; G10L 19/167; G10L 15/07; G10L 15/20; G10L 19/018;
(Continued)

(56) References Cited

U.S. PATENT DOCUMENTS 7,050,590 B2 5/2006 McPherson et al. ..... 381/56
7,467,021 B2 12/2008 Yuen et al. ..... 700/94
(Continued)

OTHER PUBLICATIONS

Dhavale, S. et al.; "Robust multiple stereo audio watermarking for copyright protection and integrity checking"; Third International Conference on Computational Intelligence and Information Technology (CIIT 2013); Oct. 18-19, 2013; pp. 9-16.
(Continued)

*Primary Examiner* — Norman Yu
(74) *Attorney, Agent, or Firm* — Harrington & Smith

(57) ABSTRACT

A protected extended playback mode protects the integrity of audio and side information of a spatial audio signal and sound object and position information of audio objects in an immersive audio capture and rendering environment. Integrity verification data for audio-related data determined. An integrity verification value is computable dependent on the transmitted audio-related data. The integrity verification value can be compared with the integrity verification data for verifying the audio-related data transmitted in the audio stream for generating a playback signal having a mode dependent on the verification of the audio-related data A transmitting device transmits that integrity verification data and the audio-related data in an audio stream for reception by a receiving device. The audio stream, including the audio-related data and integrity verification data are received by the receiving device. The integrity verification value is computed by the receiving device, compared with the integrity verification data, and a playback signal is generated depending on whether the integrity verification value matches the integrity verification data.

20 Claims, 4 Drawing Sheets

(51) Int. Cl.
*H04R 3/00* (2006.01)
*G10L 19/008* (2013.01)
*H04R 5/027* (2006.01)

(52) U.S. Cl.
CPC ..... *H04R 5/027* (2013.01); *H04S 2400/03* (2013.01); *H04S 2400/11* (2013.01); *H04S 2400/15* (2013.01)

(58) Field of Classification Search
CPC ..... G11B 20/00086; G11B 20/10527; G11B 20/10; H04S 3/008; H04S 2420/03; H04S 2400/15; H04S 2400/11; H04S 2400/03; H04S 5/02; H04S 7/30; H04R 3/005; H04R 5/027; G06F 21/44; G06F 21/6227; G06F 21/602; G06F 3/165
USPC .... 381/2, 22, 119, 23, 77; 379/406.08, 67.1; 704/500, 503, 229; 380/229, 269
See application file for complete search history.

(56) References Cited

U.S. PATENT DOCUMENTS

| | | | | |
|---|---|---|---|---|
| 7,558,954 | B2 | 7/2009 | Apostolopoulos et al. | 713/161 |
| 8,009,837 | B2 | 8/2011 | Van den Berghe | 381/22 |
| 8,929,558 | B2 | 1/2015 | Engdegard et al. | 381/17 |
| 9,055,371 | B2 | 6/2015 | Tammi et al. | 381/1 |
| 9,313,599 | B2 | 4/2016 | Tammi et al. | 381/26 |
| 2003/0103645 | A1* | 6/2003 | Levy | H04N 1/32208 382/100 |
| 2009/0063159 | A1* | 3/2009 | Crockett | G10L 19/167 704/500 |
| 2012/0128174 | A1 | 5/2012 | Tammi et al. | 381/92 |
| 2012/0155233 | A1* | 6/2012 | Spitzlinger | G11B 20/00086 369/30.09 |
| 2014/0139738 | A1 | 5/2014 | Mehta | |
| 2015/0098571 | A1 | 4/2015 | Jarvinen et al. | |
| 2015/0325243 | A1* | 11/2015 | Grant | H03G 9/005 704/229 |

OTHER PUBLICATIONS

Murray, K. et al.; "It's Not Just Integrity: Fixity Data in Digital Sound and Moving Image Files"; Mar. 4, 2014; The Signal Digital Preservation, Library of Congress; whole document (3 pages).

GB patent application No. 1518023.5 filed Oct. 12, 2015; whole document (88 pages).

GB patent application No. 1518025.0 filed Oct. 12, 2015; whole document (70 pages).

ISO/IEC 13818-7:2005(E); "Text of ISO/IEC13818-7:2005 (MPEG-2 AAC 4$^{th}$ edition)"; International Organisation for Standardisation Organisation International De Normalisation ISO/IEC JTC1/SC29/WG11 Coding of Moving Pictures and Audio; N7126; Apr. 2005; Busan, KR; 'whole document (181 pages).

ISO/IEC DIS 23008-3; "Information technology—High efficiency coding and media delivery in heterogeneous environments—Part 3: 3D audio"; ISO/IEC JTC 1/SC 29/WG 11; Jul. 25, 2014; whole document (433 pages).

* cited by examiner

PROTECTED EXTENDED PLAYBACK MODE

CROSS REFERENCE TO RELATED APPLICATION

This is a continuation of co-pending U.S. patent application Ser. No. 15/267,360, filed Sep. 16, 2016, which is hereby incorporated by reference in its entirety.

TECHNICAL FIELD

This invention relates generally to immersive audio capture and rendering environments. More specifically, this invention relates to verifying the integrity of audio and side information of a spatial audio signal, and sound object and position information of audio objects, in an immersive audio capture and rendering environment.

BACKGROUND

This section is intended to provide a background or context to the invention disclosed below. The description herein may include concepts that could be pursued, but are not necessarily ones that have been previously conceived, implemented or described. Therefore, unless otherwise explicitly indicated herein, what is described in this section is not prior art to the description in this application and is not admitted to be prior art by inclusion in this section. Abbreviations that may be found in the specification and/or the drawing figures are defined below, after the main part of the detailed description section.

U.S. patent application Ser. No. 12/927,663, filed Nov. 19, 2010 and U.S. Pat. No. 9,313,599 B2, issued Apr. 12, 2016, which are incorporated by reference herewith, describe mechanisms for ensuring backwards compatibility. That is, these references describe, for example, the ability to render an audio signal with conventional playback methods, such as stereo, for a spatial audio system.

U.S. Pat. No. 9,055,371 B2, issued Jun. 9, 2015, which is incorporated by reference herewith, describes a method for obtaining spatial audio (binaural or 5.1) from a backwards compatible input signal comprising left and right signals and spatial metadata. In accordance with this reference, original Left (L) and Right (R) microphone signals are used as a stereo signal for backwards compatibility. The (L) and (R) microphone signals can be used to create 5.1 surround sound audio and binaural signals utilizing side information. This reference also describes high quality (HQ) Left ($\hat{L}$) and Right ($\hat{R}$) signals used as a stereo signal for backwards compatibility. The HQ ($\hat{L}$) and ($\hat{R}$) signals can be used to create 5.1 surround sound audio and binaural signals utilizing side information. This reference also describes a method for ensuring backwards compatibility where a two channel spatial audio system can be made backwards compatible utilizing a codec that can use regular Mid/Side-coding, for example, ISO/IEC 13818-7:1997. Audio is inputted to the codec in a two-channel Direct/Ambient form. The typical Mid/Side calculation is bypassed and a conventional Mid/Side-flag is raised for all subbands. A decoder decodes the previously encoded signal into a form that is playable over loudspeakers or headphones. A two channel spatial audio system can be made backwards compatible where instead of sending the Direct/Ambient channels and the side information to the receiver, the original Left and Right channels are sent with the same side information. A decoder can then play back the Left and Right channels directly, or create the Direct/Ambient channels from the Left and Right channels with help of the side information, proceeding on to the synthesis of stereo, binaural, 5.1 etc. channels.

Typically, the prior attempts for backwards compatibility do not handle the situation where the audio signal or the side information has been tampered with.

Accordingly, there is a need for ensuring high quality playback and determining if an audio signal and related information transited in an audio stream has been tampered with, and if tampering is suspected or determined, an alternative playback mode made available.

BRIEF SUMMARY

This section is intended to include examples and is not intended to be limiting.

In accordance with a non-limiting exemplary embodiment, at a transmitting device, a protected extended playback mode protects the integrity of audio and side information of a spatial audio signal and sound object and position information of audio objects in an immersive audio capture and rendering environment. Integrity verification data for audio-related data determined. An integrity verification value is computable dependent on the transmitted audio-related data. The integrity verification value can be compared with the integrity verification data for verifying the audio-related data transmitted in the audio stream for generating a playback signal having a mode dependent on the verification of the audio-related data The transmitting device transmits the integrity verification data and the audio-related data in an audio stream for reception by a receiving device.

In accordance with another non-limiting, exemplary embodiment, at a receiving device, an audio stream is received where the audio stream includes audio-related data and integrity verification data. An integrity verification value is computed dependent on the received audio-related data. The integrity verification value is compared with the integrity verification data. A playback signal is generated depending on whether the integrity verification value matches the integrity verification data.

In accordance with another non-limiting, exemplary embodiment, an apparatus comprises at least one processor; and at least one memory including computer program code, the at least one memory and the computer program code configured to, with the at least one processor, cause the apparatus to perform at least the following: determine integrity verification data for audio-related data, wherein the integrity verification data and the audio-related data are transmittable in an audio stream, wherein an integrity verification value is computable dependent on the transmitted audio-related data, and the integrity verification value can be compared with the integrity verification data for verifying the audio-related data transmitted in the audio stream for generating a playback signal having a mode dependent on the verification of the audio-related data; and transmit the audio-related data and the integrity verification data in the audio stream for reception by a receiver.

In accordance with another non-limiting, exemplary embodiment, a computer program product comprises a computer-readable medium bearing computer program code embodied therein for use with a computer, the computer program code comprising: code for providing integrity verification data for audio-related data, wherein the integrity verification data and the audio-related data are transmittable in an audio stream, wherein an integrity verification value is computable dependent on the transmitted audio-related data, and the integrity verification value can be compared with the integrity verification data for verifying the audio-related data transmitted in the audio stream for generating a playback signal having a mode dependent on the verification of the audio-related data; and code for transmitting the audio-related data and the integrity verification data in the audio stream for reception by a receiver.

In accordance with another non-limiting, exemplary embodiment, an apparatus comprises at least one processor; and at least one memory including computer program code, the at least one memory and the computer program code configured to, with the at least one processor, cause the apparatus to perform at least the following: receive an audio stream, wherein the audio stream includes audio-related data and integrity verification data; compute an integrity verification value dependent on the transmitted audio-related data; compare the integrity verification value with the integrity verification data; and generate a playback signal depending on whether the integrity verification value matches the integrity verification data.

In accordance with another non-limiting, exemplary embodiment, a computer program product comprises a computer-readable medium bearing computer program code embodied therein for use with a computer, the computer program code comprising: code for receiving an audio stream, wherein the audio stream includes audio-related data and integrity verification data; code for computing an integrity verification value dependent on the transmitted audio-related data; code for comparing the integrity verification value with the integrity verification data; and code for generating a playback signal depending on whether the integrity verification value matches the integrity verification data.

BRIEF DESCRIPTION OF THE DRAWINGS

In the attached Drawing Figures:

FIG. 2(*b*) is a logic flow diagram for receiving audio-related data and integrity verification data in a protected extended playback mode, and illustrates the operation of an exemplary method, a result of execution of computer program instructions embodied on a computer readable memory, functions performed by logic implemented in hardware, and/or interconnected means for performing functions in accordance with exemplary embodiments;

DETAILED DESCRIPTION

The word "exemplary" is used herein to mean "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

The exemplary embodiments herein describe techniques for transmitting and receiving audio-related data and integrity verification data in a protected extended playback mode. Additional description of these techniques is presented after a system into which the exemplary embodiments may be used is described.

Figure 1:
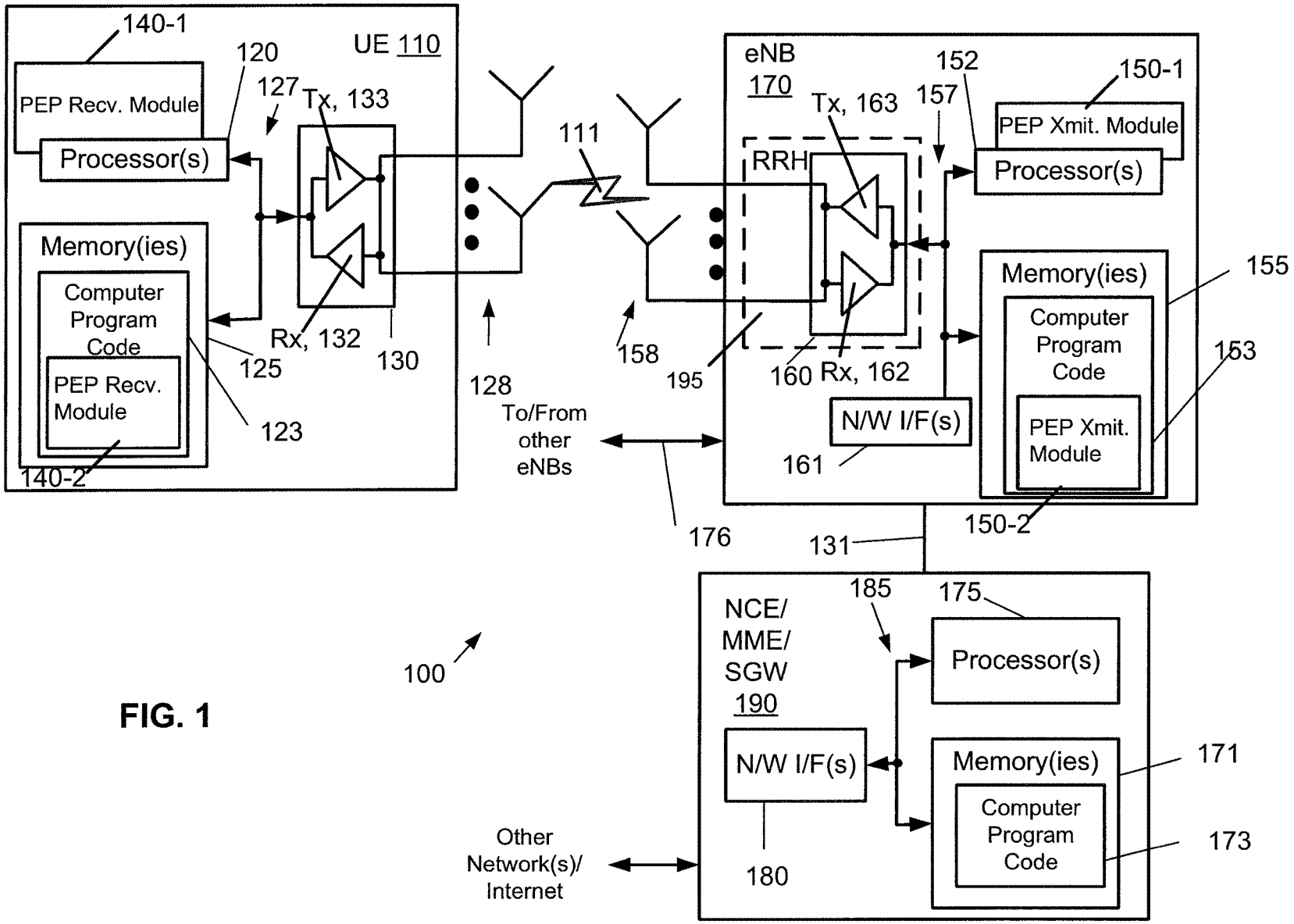
FIG. 1 is a block diagram of one possible and non-limiting exemplary system in which the exemplary embodiments may be practiced.

FIG. 1 shows an exemplary embodiment where a user equipment (UE) 110 performs the functions of a receiver of audio-related data and integrity verification data, and a base station, eNB (evolved NodeB) 170, performs the functions of a transmitter of audio-related data and integrity verification data in a protected extended playback mode. However, the UE 110 can be the transmitter and the eNB 170 can be the receiver, and these are examples of a variety of devices that can perform the functions of transmitted and receiver. Other non-limiting examples of transmitter and receiver devices include transmitter devices, such as a mobile phone, VR camera, camera, laptop, tablet, computer, server and receiver device such as a mobile phone, HIVID+headphones, computer, tablet, and laptop Turning to FIG. 1, this figure shows a block diagram of one possible and non-limiting exemplary system in which the exemplary embodiments may be practiced. In FIG. 1, a user equipment (UE) 110 is in wireless communication with a wireless network 100. A UE is a wireless, typically mobile device that can access a wireless network. The UE 110 includes one or more processors 120, one or more memories 125, and one or more transceivers 130 interconnected through one or more buses 127. Each of the one or more transceivers 130 includes a receiver, Rx, 132 and a transmitter, Tx, 133. The one or more buses 127 may be address, data, or control buses, and may include any interconnection mechanism, such as a series of lines on a motherboard or integrated circuit, fiber optics or other optical communication equipment, and the like. The one or more transceivers 130 are connected to one or more antennas 128. The one or more memories 125 include computer program code 123. The UE 110 includes a protected extended playback receiving (PEP Recv.) module 140, comprising one of or both parts 140-1 and/or 140-2, which may be implemented in a number of ways. The protected extended playback receiving module 140 may be implemented in hardware as protected extended playback receiving module 140-1, such as being implemented as part of the one or more processors 120. The protected extended playback receiving module 140-1 may be implemented also as an integrated circuit or through other hardware such as a programmable gate array. In another example, the protected extended playback receiving module 140 may be implemented as protected extended playback receiving module 140-2, which is implemented as computer program code 123 and is executed by the one or more processors 120. For instance, the one or more memories 125 and the computer program code 123 may be configured to, with the one or more processors 120, cause the user equipment 110 to perform one or more of the operations as described herein. The UE 110 communicates with eNB 170 via a wireless link 111.

The eNB 170 is a base station (e.g., for LTE, long term evolution) that provides access by wireless devices such as the UE 110 to the wireless network 100. The eNB 170 includes one or more processors 152, one or more memories 155, one or more network interfaces (N/W I/F(s)) 161, and one or more transceivers 160 interconnected through one or more buses 157. Each of the one or more transceivers 160 includes a receiver, Rx, 162 and a transmitter, Tx, 163. The one or more transceivers 160 are connected to one or more antennas 158. The one or more memories 155 include computer program code 153. The eNB 170 includes a protected extended playback transmitting (PEP Xmit.) module 150, comprising one of or both parts 150-1 and/or 150-2, which may be implemented in a number of ways. The protected extended playback transmitting module 150 may be implemented in hardware as protected extended playback transmitting module 150-1, such as being implemented as part of the one or more processors 152. The protected extended playback transmitting module 150-1 may be implemented also as an integrated circuit or through other hardware such as a programmable gate array. In another example, the protected extended playback transmitting module 150 may be implemented as protected extended playback transmitting module 150-2, which is implemented as computer program code 153 and is executed by the one or more processors 152. For instance, the one or more memories 155 and the computer program code 153 are configured to, with the one or more processors 152, cause the eNB 170 to perform one or more of the operations as described herein. The one or more network interfaces 161 communicate over a network such as via the links 176 and 131. Two or more eNBs 170 communicate using, e.g., link 176. The link 176 may be wired or wireless or both and may implement, e.g., an X2 interface.

The one or more buses 157 may be address, data, or control buses, and may include any interconnection mechanism, such as a series of lines on a motherboard or integrated circuit, fiber optics or other optical communication equipment, wireless channels, and the like. For example, the one or more transceivers 160 may be implemented as a remote radio head (RRH) 195, with the other elements of the eNB 170 being physically in a different location from the RRH, and the one or more buses 157 could be implemented in part as fiber optic cable to connect the other elements of the eNB 170 to the RRH 195.

The wireless network 100 may include a network control element (NCE) 190 that may include MME (Mobility Management Entity)/SGW (Serving Gateway) functionality, and which provides connectivity with a further network, such as a telephone network and/or a data communications network (e.g., the Internet). The eNB 170 is coupled via a link 131 to the NCE 190. The link 131 may be implemented as, e.g., an Si interface. The NCE 190 includes one or more processors 175, one or more memories 171, and one or more network interfaces (N/W I/F(s)) 180, interconnected through one or more buses 185. The one or more memories 171 include computer program code 173. The one or more memories 171 and the computer program code 173 are configured to, with the one or more processors 175, cause the NCE 190 to perform one or more operations.

The wireless network 100 may implement network virtualization, which is the process of combining hardware and software network resources and network functionality into a single, software-based administrative entity, a virtual network. Network virtualization involves platform virtualization, often combined with resource virtualization. Network virtualization is categorized as either external, combining many networks, or parts of networks, into a virtual unit, or internal, providing network-like functionality to software containers on a single system. Note that the virtualized entities that result from the network virtualization are still implemented, at some level, using hardware such as processors 152 or 175 and memories 155 and 171, and also such virtualized entities create technical effects.

The computer readable memories 125, 155, and 171 may be of any type suitable to the local technical environment and may be implemented using any suitable data storage technology, such as semiconductor based memory devices, flash memory, magnetic memory devices and systems, optical memory devices and systems, fixed memory and removable memory. The computer readable memories 125, 155, and 171 may be means for performing storage functions. The processors 120, 152, and 175 may be of any type suitable to the local technical environment, and may include one or more of general purpose computers, special purpose computers, microprocessors, digital signal processors (DSPs) and processors based on a multi-core processor architecture, as non-limiting examples. The processors 120, 152, and 175 may be means for performing functions, such as controlling the UE 110, eNB 170, and other functions as described herein.

In general, the various embodiments of the user equipment 110 can include, but are not limited to, cellular telephones such as smart phones, tablets, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, tablets with wireless communication capabilities, as well as portable units or terminals that incorporate combinations of such functions.

Figure 2A:
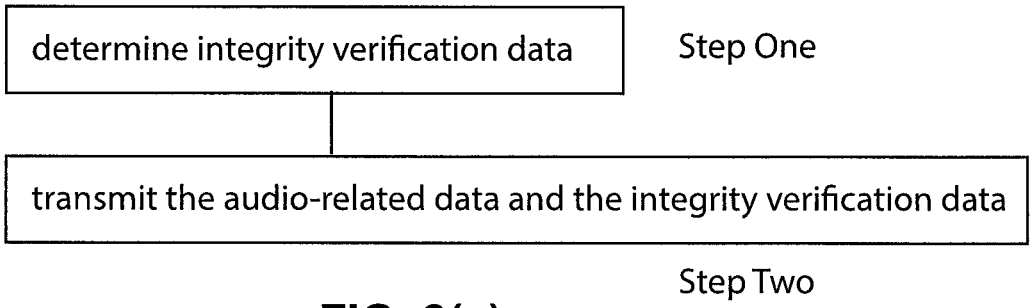
FIG. 2(*a*) is a logic flow diagram for transmitting audio-related data and integrity verification data in a protected extended playback mode, and illustrates the operation of an exemplary method, a result of execution of computer program instructions embodied on a computer readable memory, functions performed by logic implemented in hardware, and/or interconnected means for performing functions in accordance with exemplary embodiments; and\
Figure 2B:
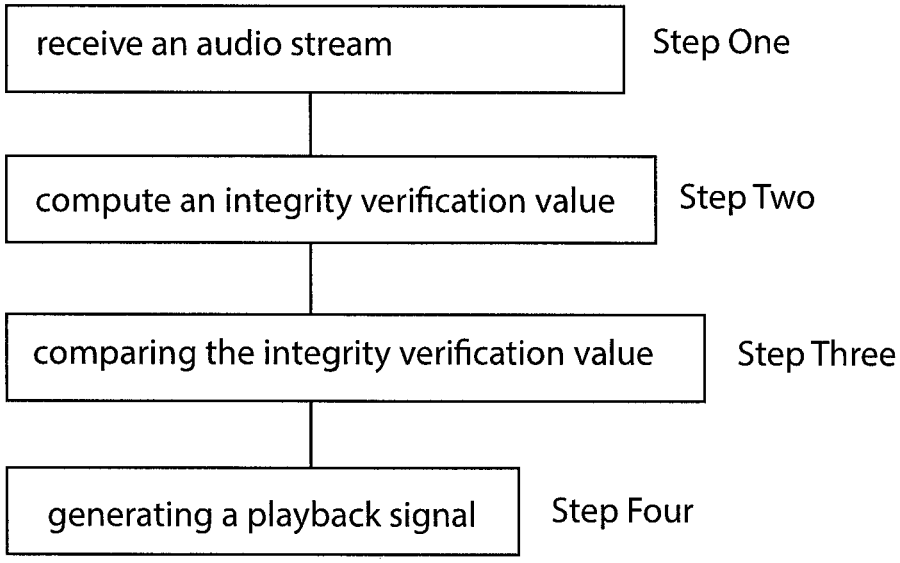

FIG. 2(*a*) is a logic flow diagram for transmitting audio-related data and integrity verification data in a protected extended playback mode. This figure further illustrates the operation of an exemplary method, a result of execution of computer program instructions embodied on a computer readable memory, functions performed by logic implemented in hardware, and/or interconnected means for performing functions in accordance with exemplary embodiments. For instance, the protected extended playback transmitting module 150 may include multiples ones of the blocks in FIG. 2*a*), where each included block is an interconnected means for performing the function in the block. The blocks in FIG. 2(*a*) are assumed to be performed by a base station such as eNB 170, e.g., under control of the protected extended playback transmitting module 150 at least in part.

In accordance with the flowchart shown in FIG. 2(*a*), integrity verification data for audio-related data are determined (Step One). The integrity verification data and the audio-related data are transmittable in an audio stream. For example, the audio stream may be transmitted wirelessly over a cellular telephone network, or communicated over a network such as the Internet. The audio-related data and the integrity verification data are transmitted in the audio stream (Step Two) for reception by a receiver capable of computing an integrity verification value dependent on the transmitted audio-related data, comparing the integrity verification value with the integrity verification data for verifying the audio-related data transmitted in the audio stream, and generating a playback signal having a mode that is dependent verification of the audio-related data.

FIG. 2(*b*) is a logic flow diagram for receiving audio-related data and integrity verification data in a protected extended playback mode. This figure further illustrates the operation of an exemplary method, a result of execution of computer program instructions embodied on a computer readable memory, functions performed by logic implemented in hardware, and/or interconnected means for performing functions in accordance with exemplary embodiments. For instance, the protected extended playback receiving module 140 may include multiples ones of the blocks in FIG. 2(*b*), where each included block is an interconnected means for performing the function in the block. The blocks in FIG. 2(*b*) are assumed to be performed by the UE 110, e.g., under control of the protected extended playback receiving module 140 at least in part.

In accordance with the flowchart shown in FIG. 2(*b*), an audio stream is received (Step One). The audio stream includes audio-related data and integrity verification data. An integrity verification value is computed dependent on the transmitted audio-related data (Step Two). The integrity verification value is compared with the integrity verification data (Step Three). A playback signal is generated depending on whether the integrity verification value matches the integrity verification data (Step Four).

Figure 3:
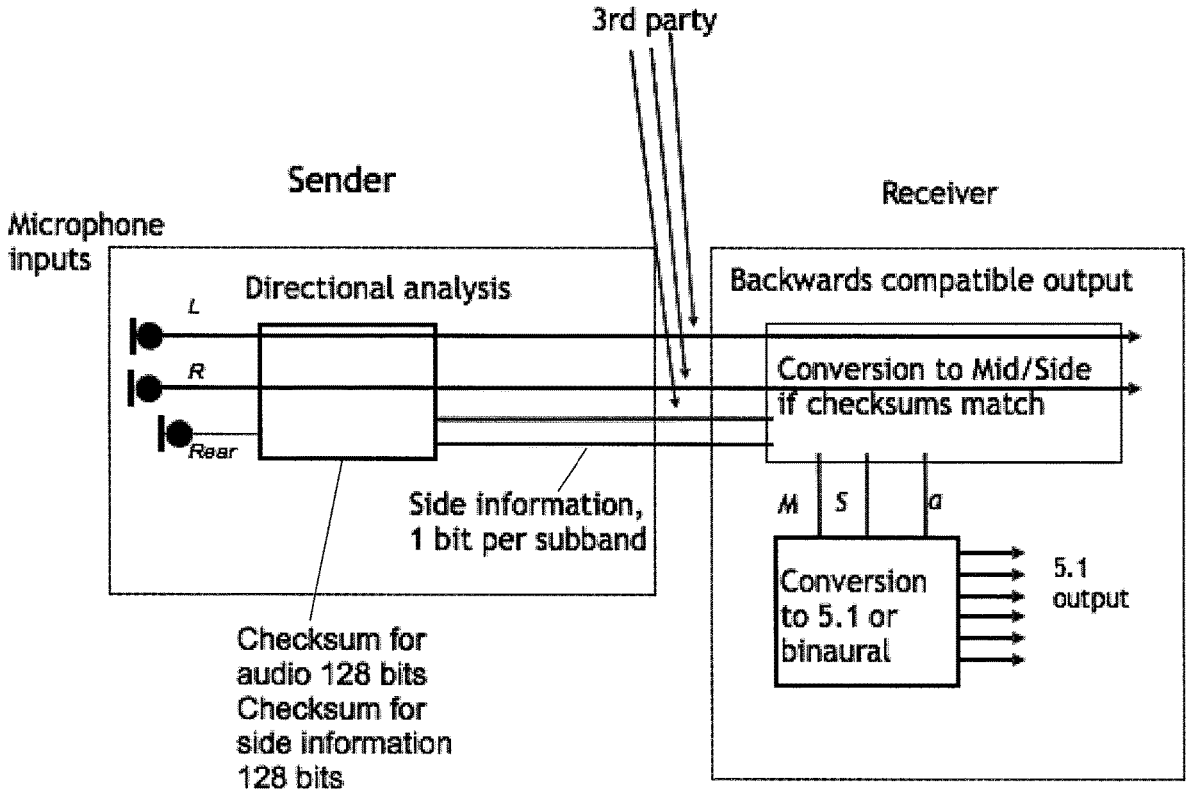
FIG. 3 illustrates an exemplary embodiment of a protected extended playback mode.

As shown, for example, in FIG. 3, in accordance with a non-limiting exemplary embodiment a protected extended playback mode protects the integrity of audio and side information of a spatial audio signal and sound object and position information of audio objects in an immersive audio capture and rendering environment.

In a typical spatial audio signal, there may be ambience information (background signal) and distinct sound sources, for example, someone is talking or a bird is singing. These sound sources are sound objects and they have certain characteristics such as direction, signal conditions (amplitude, frequency response etc). Position information of the sound object relates to, for example, a direction of the sound object relative to a microphone that receives an audio signal from the sound object.

Integrity verification data for audio-related data determined. A transmitting device (Sender) transmits that integrity verification data and the audio-related data in an audio stream for reception by a receiving device (Receiver). The audio stream, including the audio-related data and integrity verification data are received by the receiving device. An integrity verification value is computed by the receiving device dependent on the transmitted audio-related data. The integrity verification value is compared with the integrity verification data, and a playback signal is generated depending on whether the integrity verification value matches the integrity verification data.

In accordance with a non-limiting, exemplary embodiment, at a receiving device, an audio stream is received where the the audio stream includes audio-related data and integrity verification data. An integrity verification value is computed dependent on the transmitted audio-related data. The integrity verification value is compared with the integrity verification data. A playback signal is generated depending on whether the integrity verification value matches the integrity verification data.

If the integrity verification value matches the integrity verification data, the mode of the playback signal is an extended playback mode. The extended playback mode may comprise at least one of binaural and multichannel audio rendering. If the integrity verification value does not match the integrity verification data, the mode of the playback signal is a backwards compatible playback mode. The backwards compatible playback mode may comprise one of mono, stereo, and stereo plus center audio rendering. The audio-related data may audio data and spatial data. The audio data may include mid signal audio information and side signal ambiance information. The spatial data includes sound object information and position information of a source of a sound object. The sound objects may be individual tracks with digital audio data. The position information may include, for example, azimuth, elevation, and distance.

The integrity verification value may a checksum of the audio-related data. The integrity verification value may comprise a bit string having a fixed size determined using a cryptographic hash function from the audio-related data having an arbitrary size. The integrity verification value may comprise a count of a number of transmittable data bits dependent on the audio-related data transmittable in the audio stream, and wherein the receiver is capable of computing the integrity verification value as a count of a number of received data bits of the audio-related data received by the receiver in the transmitted audio stream.

The audio-related data may include one or more layers including at least one of an audio signal including a basic spatial audio layer, side information including a spatial audio metadata layer, an external object audio signal including a sound object layer, and external object position data including a sound object position metadata layer. If the integrity verification value matches the integrity verification data, the spatial metadata can be rendered and the sound objects can be panned depending on the rendered spatial metadata.

The integrity verification data may comprise at least one respective checksum included with a corresponding layer. The integrity verification value can be computed from one or more of the respective checksums. A separate integrity verification value may be computed for each checksum for verifying the audio-related data in each corresponding layer.

A non-limiting, exemplary embodiment verifies the integrity of spatial audio (audio and side information) and audio objects (sound object and position info) in an immersive audio capture and rendering environment. As an example, the integrity of spatial audio playback is protected where a sender adds integrity verification data, such as, for example, a checksum or any integrity verification mechanism, to audio-related data (e.g., an audio signal and/or side information) in an audio stream transmitted to the receiver. A checksum is a count of the number of bits in a transmission unit that is included with the unit so that the receiver can check to see whether the same number of bits arrived. If the counts match, it is assumed that the complete transmission was received.

At the receiver side, checksum is again computed and matched against received checksum. If both the checksums match then receiver enables an extended playback mode (for example, binaural or multichannel audio rendering) otherwise, a backward compatible playback mode (for example, normal stereo) is enabled. That is, if the integrity verification value matches the integrity verification data, the mode of the playback signal is an extended playback mode. The extended playback mode may comprise at least one of binaural and multichannel audio rendering.

If the integrity verification value does not match the integrity verification data, the mode of the playback signal is a backwards compatible playback mode. The backwards compatible playback mode may comprises one of mono, stereo, and stereo plus mix center audio rendering.

In a non-limiting exemplary embodiment, the integrity of spatial audio and audio object playback is protected. In this case, verification data and an integrity verification value (e.g., checksums) are added to an audio signal (basic spatial audio layer), side information (spatial audio metadata layer), external object audio signal (sound object layer), and external object position data (sound object position metadata layer) in the audio stream transmitted to the receiver. The checksum can be added for each layer separately or jointly or in any combination. In one mode (joint integrity verification), checksums are used to determine the integrity of the all the layers jointly.

At the receiver side, if the checksums match, then the receiver enables extended playback mode along with sound object spatial panning (pan the sound objects to their correct positions), otherwise a legacy playback mode (normal stereo plus mix center) is enabled. The "mix center" is a method where the sound objects (which are typically mono tracks) are added directly with equal level to both stereo channels. For example if M is a mono sound object track then the Left and Right stereo channel (L, R respectively) become Lnew=L+1/2*M, Rnew=R+1/2*M. The choice of ½ as a multiplier is dependent on the number of sound objects (and possibly on the number of other channels). Here we have only 1 object and 2 channels (L and R), therefore ½ is a common choice. Other choices could be 1/(n*m) where n is the number of channels and m the number of objects.

In another non-limiting, exemplary embodiment, layered integrity verification) is used where checksums protect the spatial audio layer (spatial audio plus side information) and the sound object layer (sound object external signal plus position information) separately. At the receiver side, if the checksum for the spatial audio layer matches then the receiver renders the spatial audio in extended playback mode, and if the checksum for sound object layer matches then the receiver renders sound objects as properly panned to their correct spatial positions. If the checksum for the spatial audio layer does not match, then the receiver renders spatial audio in legacy playback mode and similarly if checksum for sound object layer does not match, then the receiver renders a position for sound objects is mono audio mixed to the center position.

In accordance with the non-limiting, exemplary embodiments, the audio-related data may include audio data and spatial data. The audio data may include mid-audio information and side-ambiance information. The spatial data may include sound object information and position information of a source of a sound object. The integrity verification value may comprises a bit string having a fixed size determined using a cryptographic hash function from the audio-related data having an arbitrary size.

The integrity verification value may comprises a checksum of the audio-related data. The integrity verification value may comprise a count of a number of bits of the transmitted audio stream. The audio-related data may include one or more layers including at least one of an audio signal including a basic spatial audio layer, side information including a spatial audio metadata layer, an external object audio signal including a sound object layer, and external object position data including a sound object position metadata layer. If the integrity verification value matches the integrity verification data, the spatial metadata is rendered and the sound objects are panned depending on the rendered spatial metadata.

The integrity verification data may comprise at least one respective checksum included with a corresponding layer. In this case, the integrity verification value may be computed from one or more respective checksum. Also, a separate integrity verification value may be computed for each checksum for verifying the audio-related data in each corresponding layer.

An advantage of the non-limiting, exemplary embodiment includes/verifying the integrity of spatial audio and audio objects with position information. For example, if some modifications to the audio file have been created by someone or something, the system fallbacks to a safer legacy playback. In accordance with an exemplary embodiment, integrity checks (checksum or any mechanism) are used for enabling/disabling different playback modes (normal stereo, spatial playback, audio object playback, spatial audio mixing etc.) at receiver end. The rendering of audio in different playback modes can be based on whether the integrity check is performed for each layer jointly or in combination.

In accordance with the non-limiting, exemplary embodiments, a mechanism is provided for protecting the integrity of spatial audio and audio objects in immersive audio capture and rendering. The integrity protection can be automated to ensure that unwanted third party modification of the audio or metadata content of immersive audio can be detected to prevent causing undesired quality degradation during playback. The integrity of audio distributed in an immersive audio format, such as MP4VR Audio format, can be protected, allowing for the delivery of spatial audio in the form of audio plus spatial metadata and sound objects (single channel audio and position metadata).

In accordance with a non-limiting, exemplary embodiment, the integrity of spatial audio playback is protected. For example, at the sender, a checksum or other integrity verification mechanism is added for the audio signals and/or side information. At the receiver, the integrity of the audio signals and/or side information is verified, and if the integrity can be verified, an extended spatial playback mode is enabled (for example, binaural or 5.1). If, on the other hand, the integrity cannot be verified, a backwards compatible playback mode is enabled (for example, stereo format).

In accordance with a Mode 1 of a non-limiting exemplary embodiment, the integrity of the playback of spatial audio plus audio objects is protected. In this case, checksums are used to determine the integrity of one or more of the basic spatial audio layer, a spatial audio metadata layer, a sound object layer, and a sound object position metadata layer. If the checksums match, the spatial metadata is rendered and the sound objects panned to their correct positions.

In accordance with a Mode 2, checksums can be used to protect the spatial audio layer and the sound object layer separately. Thus, in this case, if the check for the spatial audio layer passes, the spatial audio is rendered instead of falling back to the stereo format audio. If the check for the sound object layer passes, sound objects are rendered and panned to their correct spatial positions. If the check for the sound object layer does not pass, the fallback position for sound objects may be, for example, mono audio mixed to the center position.

Whether to apply the Mode 1 or Mode 2 can be determined in the audio stream production stage. That is, if the capture setup is such that both the spatial audio layer and the sound object layer carry the same sound sources, it may be desirable to check the integrity jointly (Mode 1). If the spatial audio layer just carries the ambiance and does not include anything about the sources, Mode 2 may be preferred. Also, if the production is done in separate phases, such that spatial audio and objects are captured separately, it may be more advantageous to apply Mode 2 and verify the integrity of each layer separately.

FIG. 3 shows a first example of an exemplary embodiment. In the first example, the integrity of spatial audio playback is protected from degradation due to, for example, the actions of an "Evil 3$^{rd}$ party'. The "Evil 3$^{rd}$ party" may refer to, for example, a human agent trying to actively tamper with the content, or a problem in streaming, or transmission mechanism.

As an example implementation, a three microphone capture device may be used. The capture device could be any microphone array, such as the spherical OZO virtual camera with 8 microphones.

In the analysis part, the Left (L) and Right (R) microphone signals are directly used as the output and transmitted to the receiver. In the analysis part, side information regarding whether the dominant source in each frequency band came from behind or in front of the 3 microphones is also added to the transmission. The side information may take only 1 bit for each frequency band.

In the synthesis part, if a stereo signal is desired then the L and R signals can be used directly. In some embodiments the L and R signals may be direct microphone signals and in some embodiments the L and R signals may be derived from microphone signals as in U.S. application Ser. No. 12/927,663, filed on Nov. 19, 2010. In some exemplary embodiments there may be more than two signals. In some exemplary embodiments the L and R signals may be binaural signals. In some exemplary embodiments the L and R signals may be converted first to Mid (M) and Side (S) signals. In accordance with a non-limiting, exemplary embodiment, the information about whether the dominant source in that frequency band is coming from behind or in front of the 3 microphones is determined from the side information and not analyzed utilizing a third "rear" microphone.

$$\alpha_b = \begin{cases} \hat{\alpha}_b & \text{1 bit side information} = 1 \\ -\hat{\alpha}_b & \text{1 bit side information} = 0 \end{cases} \quad (1)$$

Equation (1) relates to a possible method of obtaining metadata about sound directions and describes whether the sound source direction is in front (1) or behind (0) the device receiving the sound.

In accordance with a non-limiting, exemplary embodiment, as integrity verification data, two MD5 checksums are added to audio-related data in an audio bitstream (audio stream). The MD5 algorithm is a widely used cryptographic hash function producing a 128-bit hash value. A cryptographic hash function maps data of an arbitrary size to a bit string of a fixed size. The hash function is a one-way function that is infeasible to invert. The only way the input data can be recreated from the output of an ideal cryptographic hash function is to try to create a match from a large number of attempted possible inputs.

As shown in FIG. 3, one MD5 checksum is added for the audio signals and one MD5 checksum is added for the side information as additional side information to the audio bitstream. The checksums can be computed for the complete audio file or per audio chunks. The side information can be added directly, for example, to a bitstream or added as a watermark.

In the receiver, checks against the MD5 checksum are done. If both checks match, the system proceeds to convert the (L) and (R) signals to (M) and (S) signals, which enable binaural or multichannel audio rendering. In some embodiments the conversion to (M) and (S) signals is not done, instead the rendering is done directly from the (L) and (R) signals or from a binaural signal or from a multichannel signal etc. with help of the spatial information. Using the (M) and (S) signals is only one example, and the exemplary embodiments may not necessarily require directional analysis and rendering.

If the MD5 checks do not match, the system proceeds to output a backwards compatible output (for example, normal stereo). This ensures that if spatial audio playback is enabled, the playback quality has an intended spatial perception. If the audio signal or the side information has been tampered with, legacy stereo playback is used instead to avoid the risk of faults in the quality of spatial playback.

Figure 4:
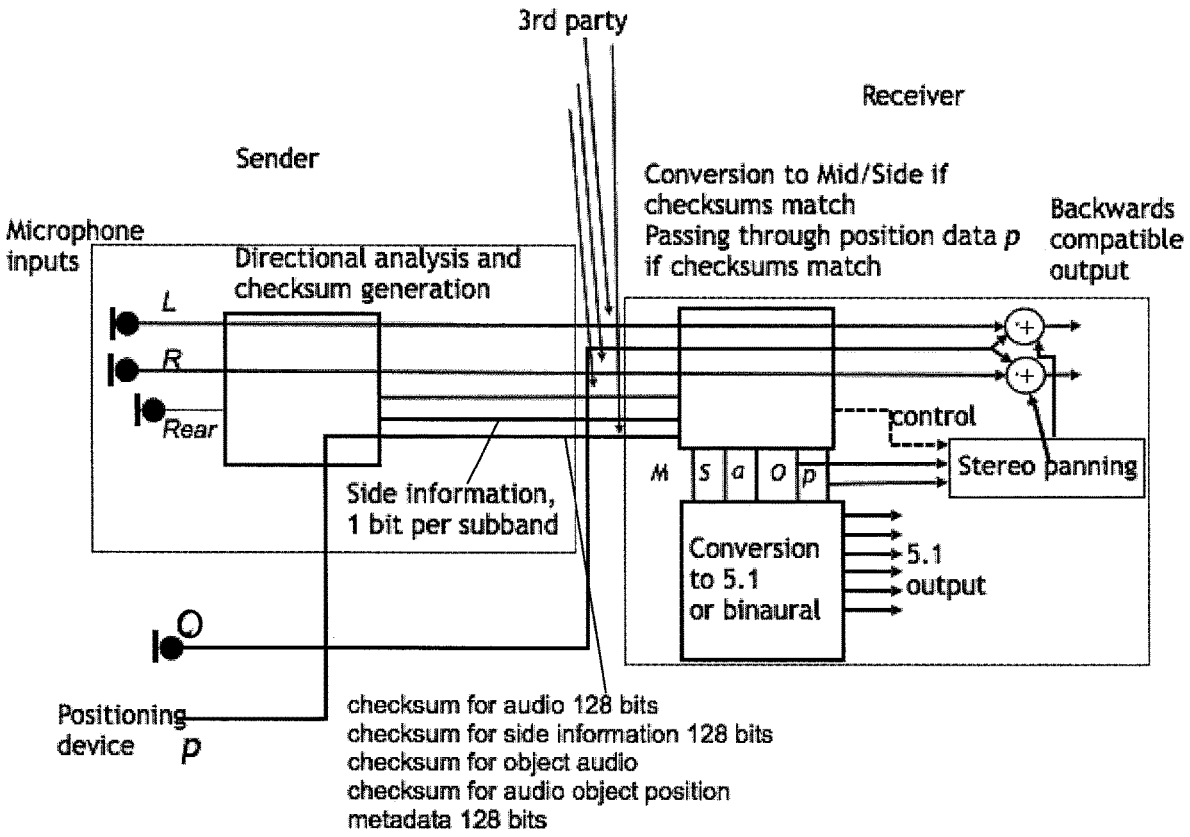
FIG. 4 illustrates another exemplary embodiment where the integrity of spatial audio and audio object playback is protected.

FIG. 4 illustrates an example where the invention is used to protect the integrity of spatial audio and audio object playback. In this case, the system comprises one or more external microphones which create audio signals O in addition to the spatial audio capture apparatus. In addition, the capture and sender side comprises a positioning device which provides position data p for the external microphone signals O. The position data p may comprise azimuth, elevation, and distance data as a function of time indicating the microphone position. Playback of spatial audio and external microphone signals involves panning audio objects O to their correct spatial positions using the position data p, either using binaural rendering techniques or Vector-Base. Amplitude Panning in the case of loudspeaker domain output. The panned audio objects are then summed to the spatial audio (binaural domain or loudspeaker domain).

In accordance with a non-limiting, exemplary embodiment, four MD5 checksums may be added to the audio stream that transmits audio-related data. The checksums may include a separate checksum for spatial audio capture device audio signals L, R; side information; external microphone audio signals O; and external microphone position data p. As an alternative to adding four separate checksums only one checksum may be added to protect the entire content of the audio-related data, or two checksums can be added for protecting the spatial audio plus metadata, and external microphone signal plus position metadata. An exemplary embodiment enables a layered protection mechanism, based on which the audio signal can be rendered in different situations. For example, two modes can be implemented:

In Mode 1 (joint integrity verification), the checksums are used to determine the integrity of the four different layers jointly. Thus, either spatial audio or legacy stereo playback will be rendered depending on the integrity of the data as determined from the checksums. Both the spatial audio playback and object audio playback may be rendered in legacy playback mode or spatial audio playback mode.

In legacy playback mode, spatial audio playback fallbacks to legacy stereo, and external microphone signal O is mixed to the center in the backwards compatible stereo signal. This can be done by mixing the external microphone signal O with constant and equal gains to the L and R signals.

In spatial audio playback mode spatial audio may be rendered using, for example, the techniques described in U.S. patent application Ser. No. 12/927,663, filed Nov. 19, 2010 and/or U.S. Pat. No. 9,313,599 B2, issued Apr. 12, 2016. Audio object panning and mixing can be implemented at locations of the microphones generating close audio signals and may be tracked using high-accuracy indoor positioning or another suitable technique. The position or location data (azimuth, elevation, distance) can then be associated with the spatial audio signal captured by the microphones. The close audio signal captured by the microphones may be furthermore time-aligned with the spatial audio signal, and made available for rendering. Static loudspeaker setups such as 5.1, may be achieved using amplitude panning techniques. For reproduction using binaural techniques, the time-aligned microphone signals can be stored or communicated together with time-varying spatial position data and the spatial audio track. For example, the audio signals could be encoded, stored, and transmitted in a Moving Picture Experts Group (MPEG) MPEG-H 3D audio format, specified as ISO/IEC 23008-3 (MPEG-H Part 3), where ISO stands for International Organization for Standardization and IEC stands for International Electrotechnical Commission.

The output in Mode 1 may then be comprised of binaural or loudspeaker domain mixed spatial audio.

Table 1 below summarizes the Mode 1 example:

TABLE 1

| | Check passes | Check does not pass |
|---|---|---|
| Spatial audio | Extended playback mode | Legacy stereo playback |
| Audio objects | Spatial panning enabled | Legacy stereo playback (mix center) |

In another example, Mode 2 (layered integrity verification), the checksums protect the spatial audio layer and the sound object layer separately. Depending on whether the checks pass or not, there are several alternatives:

Spatial Audio Check Passes

At the receiver, a check is first done to the checksums of the spatial audio and its metadata. If the checksums match, the spatial audio signal is rendered, for example, using the techniques described in U.S. patent application Ser. No. 12/927,663, filed Nov. 19, 2010 and/or U.S. Pat. No. 9,313,599 B2, issued Apr. 12, 2016.

Sound Object Check Passes

A second check is made to the external microphone audio signal O and the integrity of its position data p. If the checksums match, the spatial metadata is rendered and the sound objects panned to their correct positions. Depending on whether the spatial audio verification has passed or not, this may be done in two different ways (enabled, for example, by the control signal shown in FIG. 4). If the spatial audio integrity check has passed, spatial audio will be rendered using the techniques described in U.S. patent application Ser. No. 12/927,663, filed Nov. 19, 2010 and/or U.S. Pat. No. 9,313,599 B2, issued Apr. 12, 2016. Audio object panning and mixing may be implemented as described herein with regards to the static loudspeaker setups where a static downmix can be done using amplitude panning techniques. The output in Mode 1 may then be comprised of binaural or loudspeaker domain mixed spatial audio.

If the spatial audio integrity check has failed, spatial audio can fallback to backwards compatible output (for example, stereo). The audio objects may then be panned with stereo Vector-Base Amplitude Panning (for example, stereo panning) and mixed with suitable gains to the backwards compatible output.

If the checksums for the external microphone audio signal O and the integrity of its position data p fail, the playback of an external microphone signal fallbacks to a safe mode. The safe mode depends on whether the check for spatial audio and its metadata has passed. As safe mode examples:

spatial audio playback enabled: external microphone signal O is mixed to the center in the spatial audio signal. This can be done by modifying the position data p such that the source obtains the center position.

spatial audio playback disabled: external microphone signal O is mixed to the center in the backwards compatible stereo signal. This can be done by mixing the external microphone signal O with constant and equal gains to the L and R signals.

Table 2 summarizes the case of Mode 2 when spatial audio check passes, spatial audio in extended playback mode:

TABLE 2

| | Check passes | Check does not pass |
|---|---|---|
| Audio objects | Spatial panning enabled | Mix to center position (binaural or loudspeaker) |

Table 3 summarizes the case of Mode 2 when spatial audio check fails, spatial audio in legacy stereo playback mode:

TABLE 3

| | Check passes | Check does not pass |
|---|---|---|
| Audio objects | Stereo panning enabled, use 2 channel VBAP | Mix to center position in stereo |

Without in any way limiting the scope, interpretation, or application of the claims appearing below, a technical effect of one or more of the example embodiments disclosed herein is to ensure high quality playback of our immersive audio formats, it is desirable to implement integrity checks for the audio and/or side information. Another technical effect of one or more of the example embodiments disclosed herein is to ensure that spatial playback, if done, achieves an intended playback quality. Another technical effect of one or more of the example embodiments disclosed herein is to ensure the integrity of audio signals obtained from both spatial audio capture and automatic tracking of moving sound sources (sound objects). Another technical effect of one or more of the example embodiments disclosed herein is where if the integrity of the audio and side information cannot be ensured, a backwards compatible playback (such as conventional stereo) is available.

Embodiments herein may be implemented in software (executed by one or more processors), hardware (e.g., an application specific integrated circuit), or a combination of software and hardware. In an example embodiment, the software (e.g., application logic, an instruction set) is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted, e.g., in FIG. 1. A computer-readable medium may comprise a computer-readable storage medium (e.g., memories 125, 155, 171 or other device) that may be any media or means that can contain, store, and/or transport the instructions for use by or in connection with an instruction execution system, apparatus, or device, such as a computer. A computer-readable storage medium does not comprise propagating signals.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted that while the above describes example embodiments of the invention, these descriptions should not be viewed in a limiting sense. Rather, there are several variations and modifications which may be made without departing from the scope of the present invention as defined in the appended claims.

What is claimed is:

1. A method comprising:

receiving, with a receiver, audio data from a sender;

determining, at the receiver, whether information in the audio data has been tampered; and selecting, with the receiver, a playback type for the audio data, where the receiver selects a first playback type when the receiver has determined that the information in the audio data has not been tampered, and where the receiver selects a different second playback type when the receiver has determined that the information in the audio data has been tampered, where the first playback type and the different second playback type are configured to cause the audio data to be played differently, where the second playback type comprises one of: mono rendering, stereo rendering, spatial rendering, binaural rendering, multichannel audio rendering, or stereo plus mix center audio rendering, where the second playback type is at least partially different from the first playback type.

2. A method as in claim 1 where the determining of whether the information in the audio data has been tampered comprises the receiver computing an integrity verification value dependent on at least one portion of the audio data received with the receiver.

3. A method as in claim 2 where the determining of whether the information in the audio data has been tampered comprises the at least one portion of the audio data being verified based on a comparison of integrity verification data in the audio data received, with the receiver, versus the integrity verification value, wherein the integrity verification data comprises at least one checksum value.

4. A method as in claim 1 where the first playback type comprises one of: spatial rendering, binaural rendering, or multichannel audio rendering.

5. A method as in claim 1 where the audio data further comprises integrity verification data and one or more layers of audio-related data, and where the determining of whether the information in the audio data has been tampered comprises using the integrity verification data, where the integrity verification data comprises at least one separate integrity verification data element for the respective one or more layers for verifying the audio-related data in the audio data.

6. A method as in claim 1 further comprising rendering, with the receiver, the received audio data using either the first playback type or the second playback type, wherein the first playback type and the second playback type comprise use of at least some of the audio data during the rendering.

7. A method comprising:

receiving, with a receiver, audio data from a sender, wherein the audio data comprises at least spatial data;

determining, at the receiver, whether information in the audio data has been tampered; and selecting, with the receiver, a predetermined operation for the received audio data from a plurality of predetermined operations, where the receiver selects a first one of the predetermined operations comprising a first playback type for the received audio data when the receiver has determined that the information in the audio data has not been tampered, and where the receiver selects a different second one of the predetermined operations which does not comprise the first playback type when the receiver has determined that the information in the audio data has been tampered, where the first one of the predetermined operations and the different second one of the predetermined operations are configured to cause the audio data to be played differently, where the different second predetermined operation comprises a different second playback type, where the second playback type comprises one of: mono rendering, stereo rendering, spatial rendering, binaural rendering, multichannel audio rendering, or stereo plus mix center audio rendering, where the second playback type is at least partially different from the first playback type.

8. A method as in claim 7 further comprising rendering, with the receiver, the audio data received from the sending using either the first playback type or the second playback type.

9. A method as in claim 7 where the determining of whether the information in the audio data has been tampered comprises the receiver computing an integrity verification value dependent on at least one portion of the audio data received with the receiver.

10. A method as in claim 9 where the determining of whether the information in the audio data has been tampered comprises the at least one portion of the audio data being verified based on a comparison of integrity verification data in the audio data received, with the receiver, versus the integrity verification value.

11. A method as in claim 7 where the first playback type comprises one of: spatial rendering, binaural rendering, or multichannel audio rendering.

12. A method as in claim 7 where the audio data comprises integrity verification data and one or more layers of audio-related data, and where the determining of whether the information in the audio data has been tampered comprises using the integrity verification data, where the integrity verification data comprises at least one separate integrity verification data element for the respective one or more layers for verifying the audio-related data in the audio data.

13. A method comprising:

receiving, with a receiver, audio data from a sender, wherein the audio data comprises at least spatial data;

determining, at the receiver, whether information in the audio data has been changed since the information was sent with the sender; and selecting, with the receiver, a predetermined operation for the received audio data from a plurality of predetermined operations, where the receiver selects a first one of the predetermined operations comprising a first playback type for the received audio data when the receiver has determined that the information in the audio data has not been changed, and where the receiver selects a different second one of the predetermined operations which does not comprise the first playback type when the receiver has determined that the information in the audio data has been changed, where the first one of the predetermined operations and the different second one of the predetermined operations are configured to cause the audio data to be played differently, where the different second predetermined operation comprises a different second playback type, where the second playback type comprises one of: mono rendering, stereo rendering, spatial rendering, binaural rendering, multichannel audio rendering, or stereo plus mix center audio rendering, where the second playback type is at least partially different from the first playback type.

14. A method as in claim 13 where the first playback type comprises one of: spatial rendering, binaural rendering, or multichannel audio rendering.

15. A method as in claim 13 further comprising rendering, with the receiver, the received audio data using the first playback type.

16. A method as in claim 1, wherein the audio data comprises integrity verification data and audio-related data, wherein the audio-related data comprises at least one of:

spatial data,
an audio signal,
a sound object,
side information,
position information,
mid signal audio information, or
side signal ambiance information.

17. A method as in claim 7, wherein the audio data comprises integrity verification data and audio-related data, wherein the audio-related data comprises at least one of:

spatial data,
an audio signal,
a sound object,
side information,
position information,
mid signal audio information, or
side signal ambiance information.

18. A method as in claim 13, wherein the audio data comprises integrity verification data and audio-related data, wherein the audio-related data comprises at least one of:

spatial data,
an audio signal,
a sound object,
side information,
position information,
mid signal audio information, or
side signal ambiance information.

19. A method as in claim 10, where the integrity verification data comprises at least one checksum value.

20. A method as in claim 13, where the determining of whether the information in the audio data has been changed since the information was sent with the sender comprises:

the receiver computing an integrity verification value dependent on at least one portion of the audio data received with the receiver, and comparing the integrity verification data in the audio data received, with the receiver, versus the integrity verification value, wherein the integrity verification data comprises at least one checksum value.

* * * * *